US009893473B2

(12) United States Patent
Kong et al.

(10) Patent No.: US 9,893,473 B2
(45) Date of Patent: Feb. 13, 2018

(54) ELECTRICAL CONNECTOR HAVING SEPARATE GROUNDING PIECES

(71) Applicant: FOXCONN INTERCONNECT TECHNOLOGY LIMITED, Grand Cayman (KY)

(72) Inventors: Ling-Xiao Kong, HuaiAn (CN); Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/400,965

(22) Filed: Jan. 7, 2017

(65) Prior Publication Data

US 2017/0201048 A1 Jul. 13, 2017

(30) Foreign Application Priority Data

Jan. 8, 2016 (CN) ..... 2016 1 0010149

(51) Int. Cl.

| | |
|---|---|
| ***H01R 12/00*** | (2006.01) |
| ***H01R 13/6594*** | (2011.01) |
| ***H01R 24/60*** | (2011.01) |
| ***H01R 13/502*** | (2006.01) |
| ***H01R 13/631*** | (2006.01) |
| ***H01R 13/6582*** | (2011.01) |
| *H01R 107/00* | (2006.01) |

(52) U.S. Cl.

CPC ..... *H01R 13/6594* (2013.01); *H01R 13/502* (2013.01); *H01R 13/631* (2013.01); *H01R 13/6582* (2013.01); *H01R 24/60* (2013.01); *H01R 2107/00* (2013.01)

(58) Field of Classification Search

CPC ..... H01R 13/6594
USPC ..... 439/78
See application file for complete search history.

(56) References Cited

U.S. PATENT DOCUMENTS

| | | | | |
|---|---|---|---|---|
| 6,997,733 | B2 * | 2/2006 | Peng | H01R 13/6582 439/353 |
| 7,175,465 | B1 * | 2/2007 | Tsai | H01R 13/6275 439/352 |
| 7,575,454 | B1 * | 8/2009 | Aoki | H01R 13/641 439/188 |
| 8,100,720 | B2 * | 1/2012 | Lin | H01R 27/00 439/607.34 |

(Continued)

FOREIGN PATENT DOCUMENTS

| | | |
|---|---|---|
| CN | 203859324 | 10/2014 |

OTHER PUBLICATIONS

Universal Serial Bus Type-C Cable and Connector Specification Revision 1.2 Mar. 25, 2016, p. 31,32,33,52,53.

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes: an insulative housing having a base and a tongue; an upper and lower rows of contacts mounted in the insulative housing and exposed to the tongue; a shielding shell enclosing the insulative housing; and a pair of grounding pieces separated from each other and mounted in the insulative housing between the upper and lower rows of contacts, each grounding piece having a leg in contact with the shielding shell.

20 Claims, 14 Drawing Sheets

(56) References Cited

U.S. PATENT DOCUMENTS 8,419,473 B1 * 4/2013 Lan ..... H01R 13/405 439/607.17
8,562,378 B2 * 10/2013 Su ..... H01R 13/502 439/607.55
8,684,769 B2 4/2014 Kao et al.
8,790,138 B2 * 7/2014 Wang ..... H01R 27/02 439/607.4
8,956,179 B2 * 2/2015 MacDougall ..... H01R 13/641 439/489
9,312,644 B2 * 4/2016 Kao ..... H01R 13/6591
9,484,676 B2 * 11/2016 Chuang ..... H01R 13/6581
9,484,681 B2 * 11/2016 Little ..... H01R 13/6597
9,620,904 B2 * 4/2017 Kao ..... H01R 13/6581
9,735,511 B2 * 8/2017 Kao ..... H01R 13/5202
2011/0065308 A1 * 3/2011 Lu ..... H01B 7/0892 439/449
2013/0210284 A1 * 8/2013 Wang ..... H01R 24/64 439/660
2013/0330976 A1 12/2013 Simmel et al.
2015/0072562 A1 3/2015 Little et al.
2015/0162714 A1 * 6/2015 Yu ..... H01R 24/62 439/660
2015/0171561 A1 * 6/2015 Little ..... H01R 24/60 439/607.34
2015/0171562 A1 6/2015 Gao et al.
2015/0171574 A1 * 6/2015 Little ..... H01R 24/60 439/78
2015/0207272 A1 * 7/2015 Ning ..... H01R 13/6594 439/78
2015/0207273 A1 * 7/2015 Zhao ..... H01R 24/60 439/78
2015/0244111 A1 * 8/2015 Ju ..... H01R 13/6585 439/607.05
2015/0255911 A1 * 9/2015 Kato ..... H01R 24/64 439/345
2015/0270632 A1 * 9/2015 Takane ..... H01R 12/716 439/78
2015/0303623 A1 * 10/2015 Kao ..... H01R 13/6583 439/607.04
2015/0318646 A1 * 11/2015 Little ..... H01R 4/023 439/78
2015/0333451 A1 * 11/2015 Kao ..... H01R 24/60 439/607.01
2015/0340798 A1 * 11/2015 Kao ..... H01R 13/6594 439/660
2015/0340821 A1 * 11/2015 Yen ..... H01R 13/6581 439/607.01
2015/0340825 A1 * 11/2015 Ng ..... H01R 24/70 439/607.28
2015/0364871 A1 * 12/2015 Lin ..... H01R 13/6581 439/607.58
2016/0006195 A1 * 1/2016 Zhao ..... H01R 13/405 439/676
2016/0020572 A1 1/2016 Ju et al.
2016/0181744 A1 * 6/2016 Kao ..... H01R 13/6581 439/676
2016/0211593 A1 * 7/2016 Tsai ..... H01R 13/6658
2017/0201048 A1 * 7/2017 Kong ..... H01R 13/6594

* cited by examiner

ELECTRICAL CONNECTOR HAVING SEPARATE GROUNDING PIECES

BACKGROUND OF THE INVENTION

1. Field of the Invention

The present invention relates to an electrical connector having an adequately configured grounding piece with respect to contacts thereof.

2. Description of Related Arts

China Patent No. 203859324, issued on Oct. 1, 2014, discloses an electrical connector having an insulative housing, an upper and lower rows of contacts in the insulative housing, a center grounding piece between the upper and lower rows of contacts, and an outer metallic shell. The grounding piece has a main body, a pair of side tabs bent from the main body, and a rear portion for engaging and therefore grounding to the outer shell. In the case that the tongue portion of the housing to which the contacts and the grounding piece are mounted is relatively thin and the desired high current is to be conducted by the contacts for quick charging, there is concern that the main body of the grounding piece might be situated too close to the contacts with a potential risk of shorting.

SUMMARY OF THE INVENTION

An electrical connector comprises an insulative housing having a base and a tongue; an upper and lower rows of contacts mounted in the insulative housing and exposed to the tongue; a shielding shell enclosing the insulative housing; and a pair of grounding pieces separated from each other and mounted in the insulative housing between the upper and lower rows of contacts, each grounding piece having a leg in contact with the shielding shell. The pair of grounding pieces are separated from each other so that the contacts other than grounding contacts are stayed away from the grounding pieces while the insulative housing is strong enough by the presence of the two separated grounding pieces. The thickness of the contact can be set within a range between 0.16 mm and 0.22 mm to deliver the high current for quick charging, compared with the traditional contact having a thickness of 0.15 mm approximately. In the invention, the traditional metallic shielding plate between two rows of contacts is intentionally eliminated while only leaving a pair of spaced grounding pieces on two opposite lateral side regions, thus assuring the thickened contacts will not be shorted with any metallic shielding/grounding part in the vertical direction.

DETAILED DESCRIPTION OF THE PREFERRED EMBODIMENT

Figure 1:
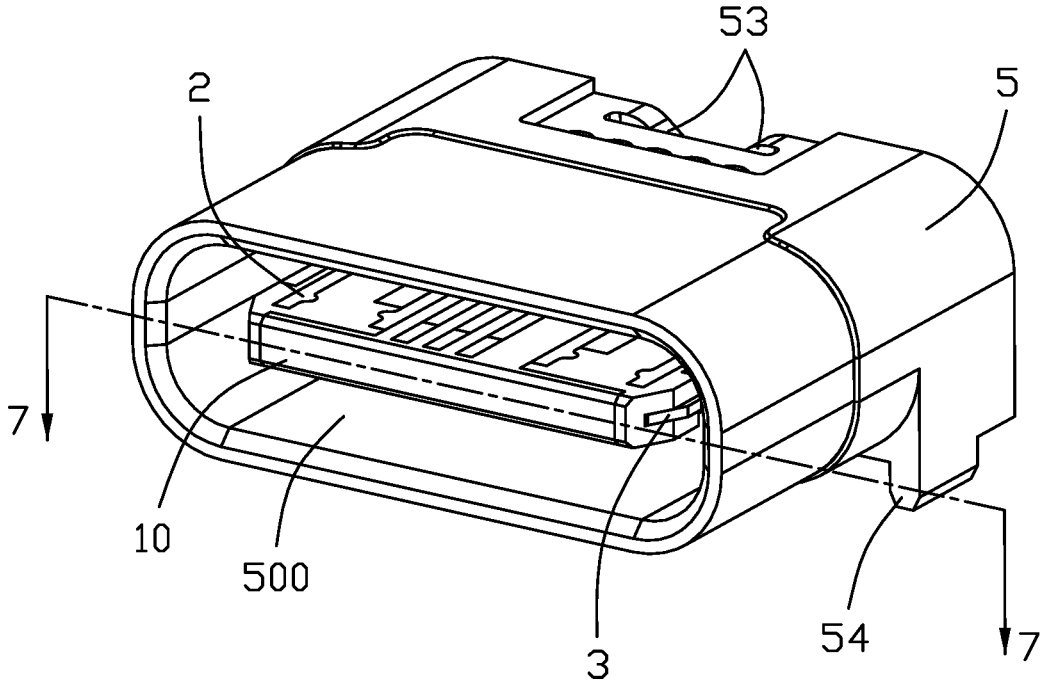
FIG. 1 is a perspective view of an electrical connector in accordance with the present invention.
Figure 2:
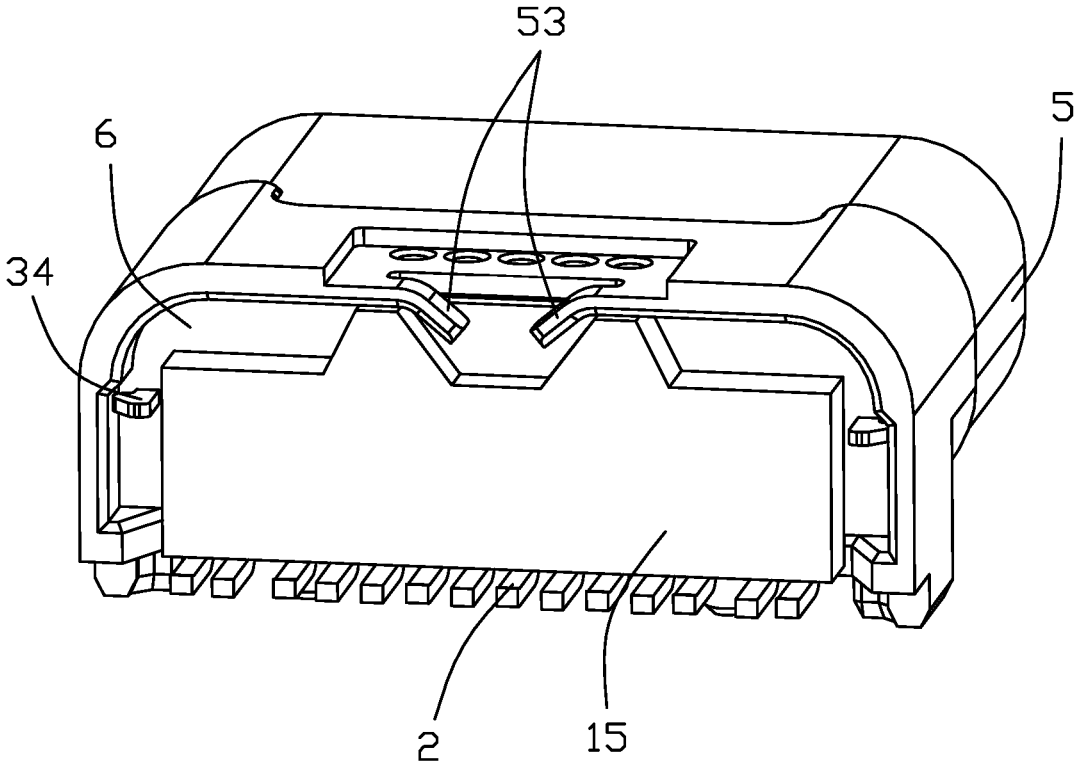
FIG. 2 is another perspective view of the electrical connector of FIG. 1.
Figure 3:
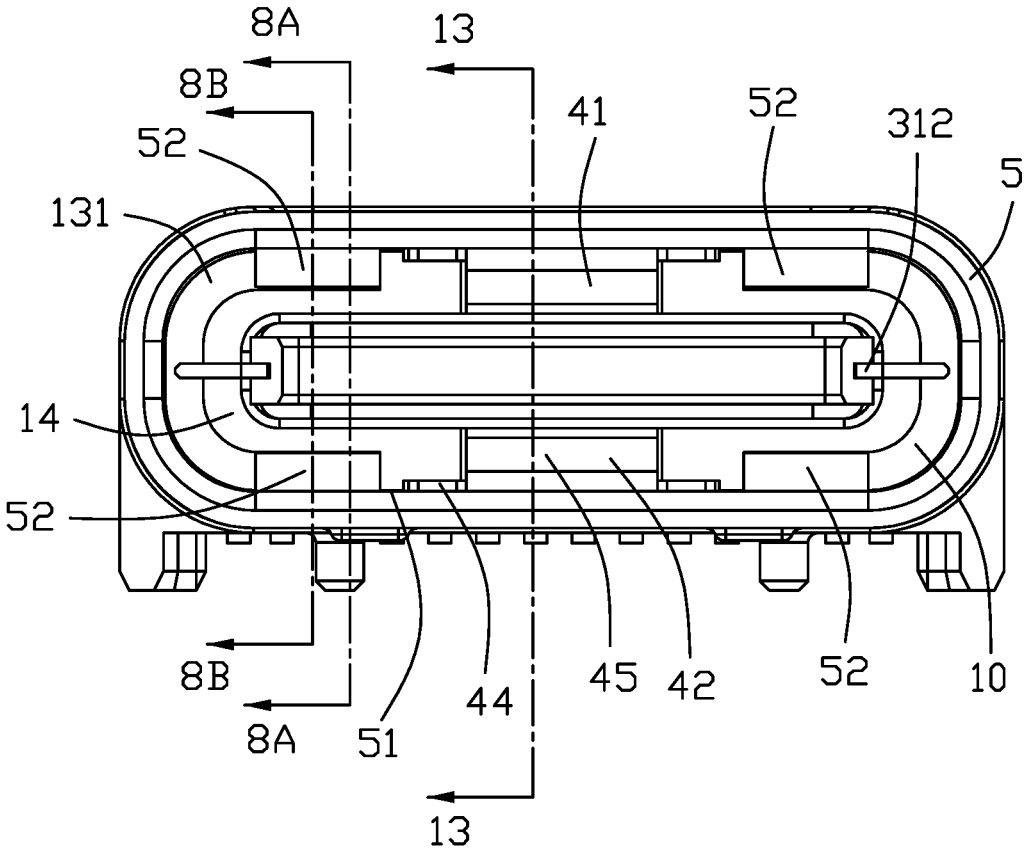
FIG. 3 is a front view of the electrical connector of FIG. 1.
Figure 4:
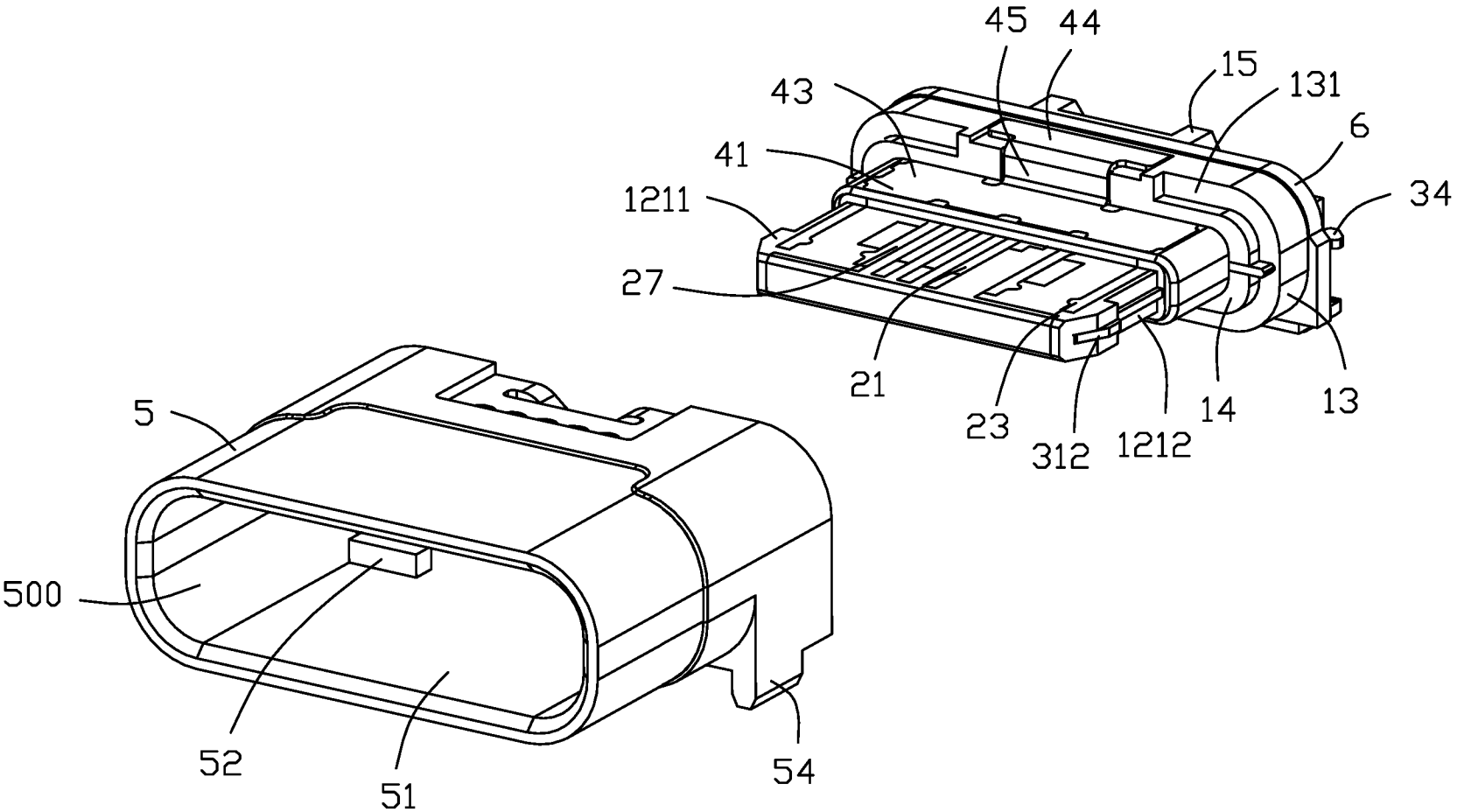
FIG. 4 is an exploded view of the electrical connector of FIG. 1.
Figure 5:
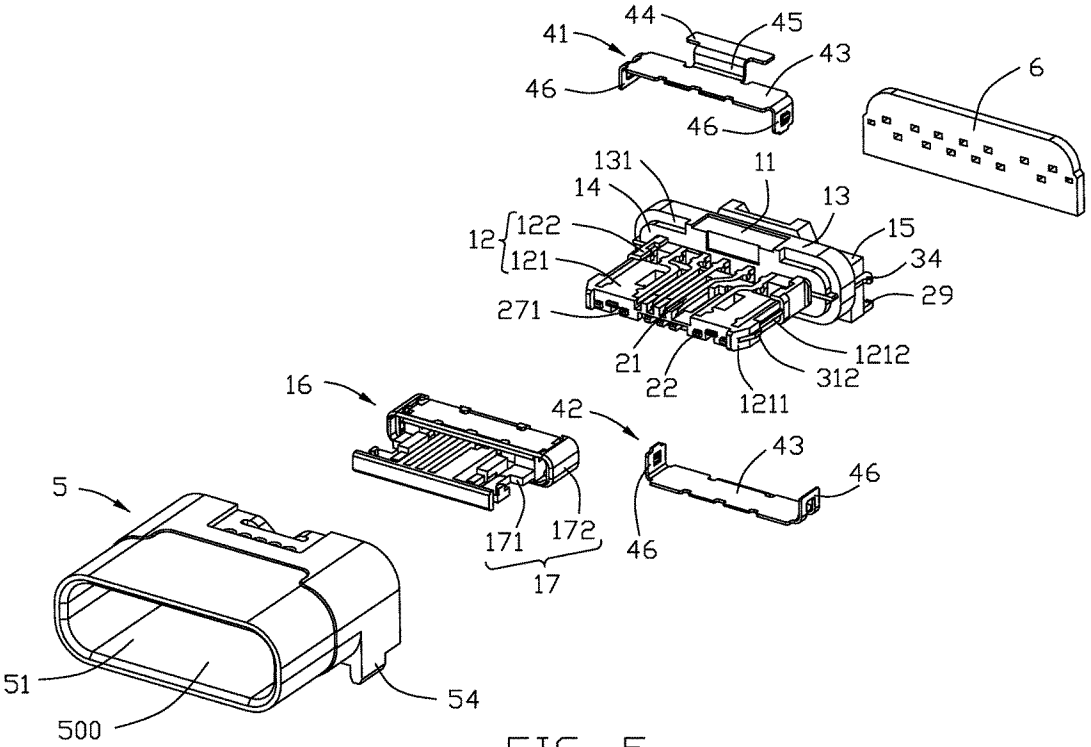
FIG. 5 is a further exploded view of FIG. 4.
Figure 6:
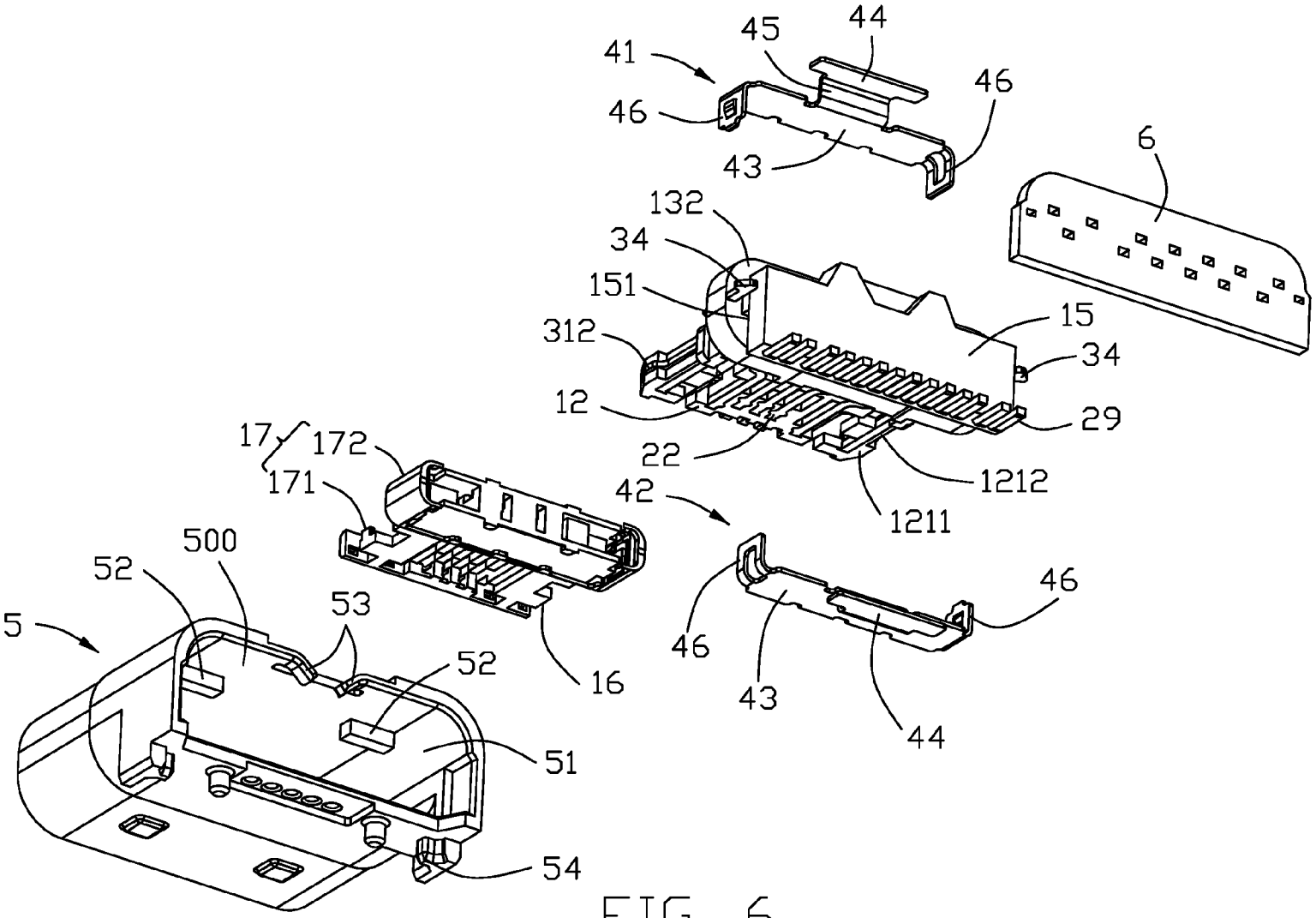
FIG. 6 is a view similar to FIG. 5 but from a different perspective.
Figure 7:
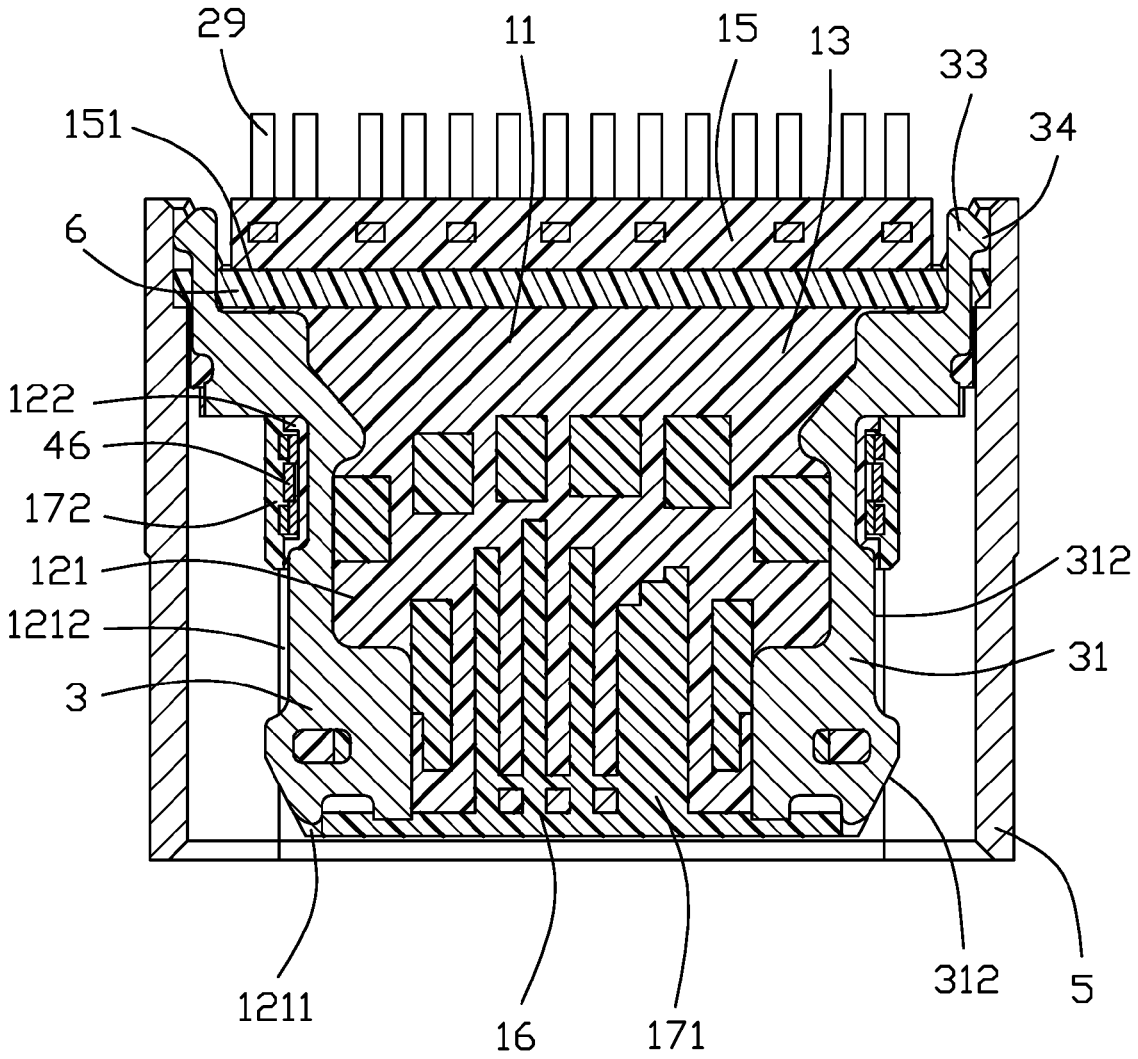
FIG. 7 is a cross-sectional view of the electrical connector of FIG. 1 taken along line 7-7.
Figure 8A:
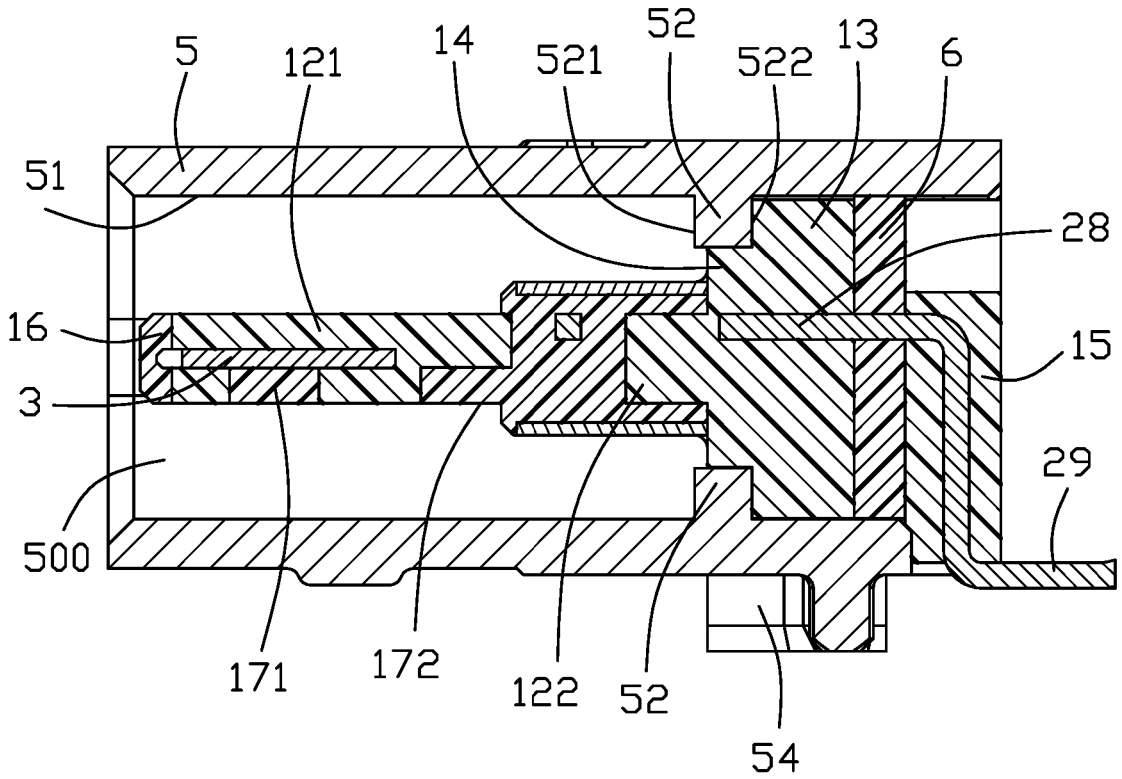
FIG. 8(A) is a cross-sectional view of the electrical connector of FIG. 3 taken along line 8A-8A.
Figure 8B:
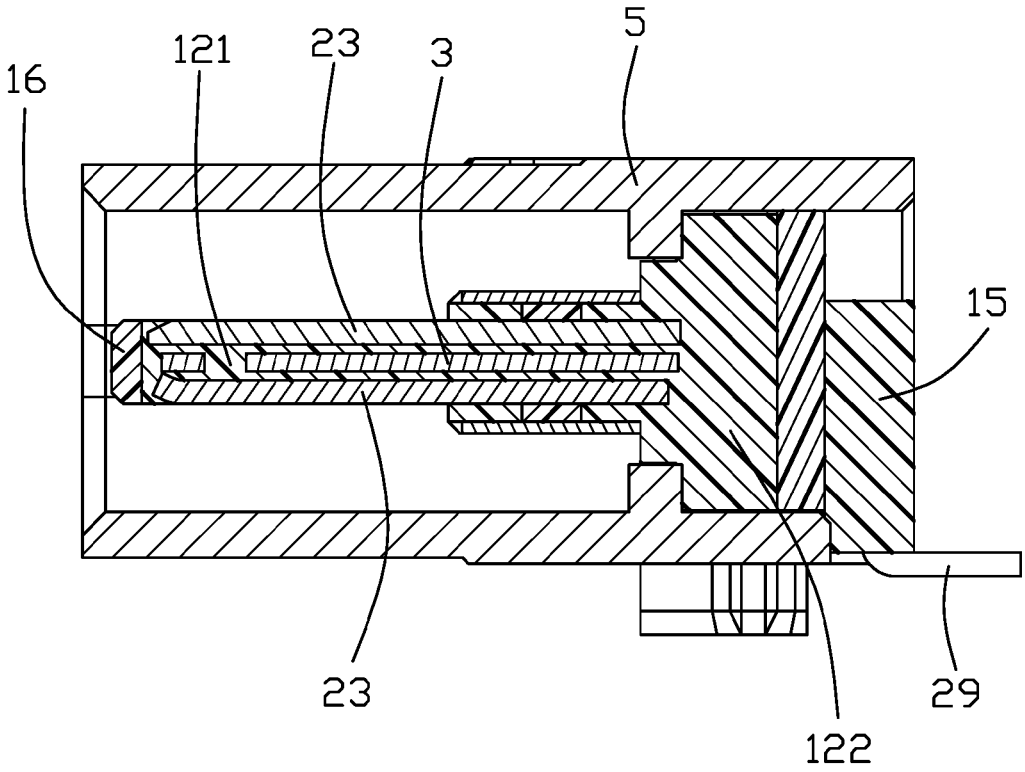
FIG. 8(B) is a cross-sectional view of the electrical connector of FIG. 3 taken along line 8B-8B.
Figure 9:
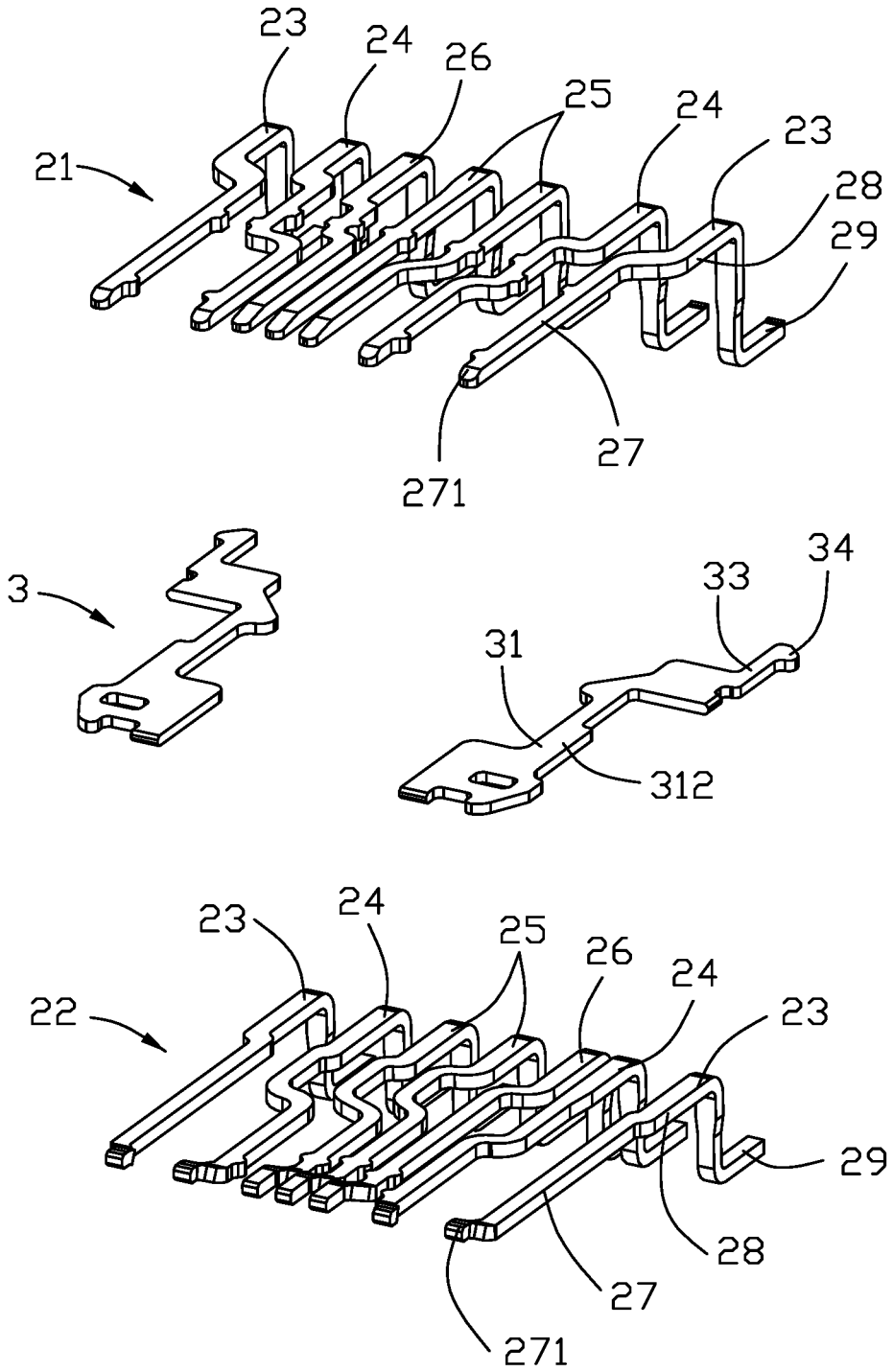
FIG. 9 is a view showing relationship between an upper and lower rows of contacts and a pair of separated grounding pieces.
Figure 10:
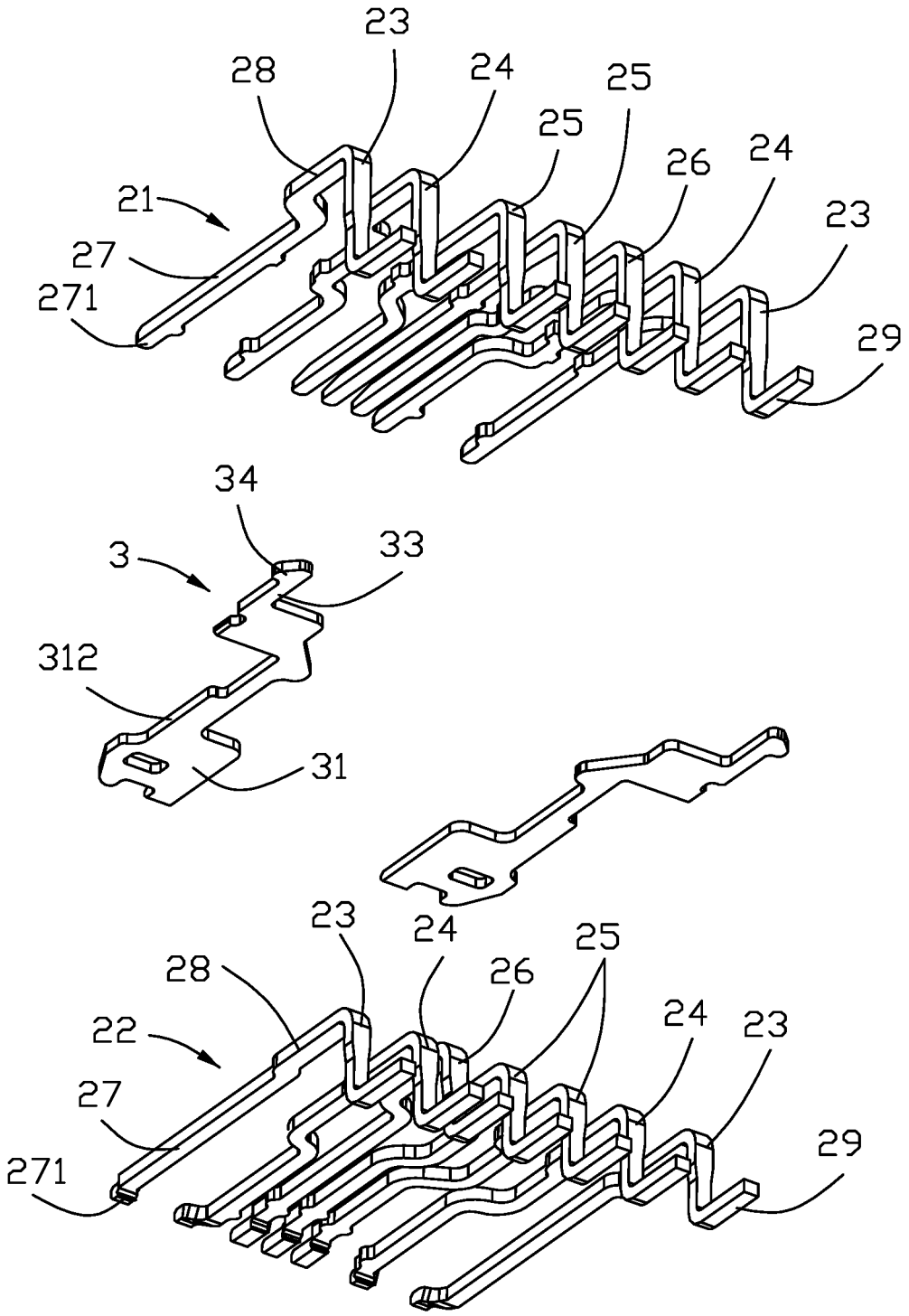
FIG. 10 is a view similar to FIG. 9 but from a different perspective.

Referring to FIGS. 1 to 13, an electrical connector defines at a front thereof an insertion space 500 for receiving a mating connector.

In the embodiment of FIGS. 1 to 13, the electrical connector comprises an insulative housing 10 having a base 13 and a tongue (not labeled), a plurality of contacts 2 including an upper row of contacts 21 and a lower rows of contacts 22 mounted in the insulative housing 10, a metallic element including a pair of grounding pieces 3 separated from each other and mounted in the insulative housing 10 between the upper/first and lower/second rows of contacts 21 and 22, and an outer shielding shell 5 enclosing the insulative housing 10. The electrical connector further comprises an upper and lower inner shells 41 and 42 and a sealing element 6 applied to a rear of the insulative housing 10.

The insulative housing 10 is constructed of a first insert-molding 11 and a second insert-molding 16 wherein the first insert-molding 11 with the contacts 2 is regarded as the initial terminal module while the housing 10 with the contacts 2 is regarded as the complete terminal module.

The first insert-molding 11 is constructed of the base 13 and a first tongue portion 12. The first tongue portion 12 has a front part 121, a rear part 122, and a plurality of holes through the front and rear parts 121 and 122. The front part 121 has a pair of grooves 1212 at two opposite sides thereof and a pair of protrusions 1211 in front of the grooves 1212. The base 13 includes a front wall 131, a rear wall 132, a front step 14, a rear extension 15, and a groove 151 generally between the wall 132 and the extension 15 where the sealing element 6 is formed. The rear part 122 is connected with the front step 14. The second insert-molding 16 constitutes a second tongue portion 17 and has a front part 171 and a rear part 172.

The first and second tongue portions 12 and 17 together form the tongue of the insulative housing 10.

Each row of the upper/first and lower/second rows of contacts 21 and 22 include a pair of grounding contacts 23, a pair of power contacts 24, a pair of signal contacts 25, and one detect contact 26. The grounding contacts 23 of either the upper row of contacts 21 or the lower row of contacts 22 are arranged at two outermost positions, i.e., the opposite lateral sides of the housing 10 or the tongue, and respective power contacts 24, signal contacts 25, and detect contact 26 are arranged between associated pair of grounding contacts 23. The contact 21 or 22 has a thickness of about 0.2 mm. Each contact 21 or 22 has a contact portion 27, a securing portion 28, and a tail portion 29. The contact portion 27 has an embedded end 271.

The pair of grounding pieces 3 are separated from each other and each has a securing portion 31 and a leg 33 extending rearwardly. The securing portion 31 has an abutment 312 extending sidewardly outward for latchable engagement with a deflectable latch of a plug connector mateable with the subject electrical connector.

The upper and lower inner shells 41 and 42 are conductive for grounding purpose and each shell includes a first main part 43, a second main part 44, a connection 45, and a pair of securing parts 46. The first and second main parts 43 and 44 are parallel to each other. The pair of securing parts 46 of the upper inner shell 41 are interlocked to the pair of securing parts 46 of the lower inner shell 42.

The outer shielding shell 5 is also conductive and has a pair of grounding posts 54. The outer shielding shell 5 is generally tubular and has an interior surface 51, together the tongue of the insulative housing 10, to form an insertion space 500. The outer shielding shell 5 further has four lugs 52 on the interior surface 51 and a pair of stops 53.

The upper and lower rows of contacts 21 and 22 and the grounding pieces 3 are insert molded with the insulative housing 10 in a generally known manner to expose the contact portions 27 to the tongue.

Each of the pair of grounding pieces 3 is aligned between a corresponding grounding contact 23 of the upper row of contacts 21 and a corresponding grounding contact 23 of the lower row of contacts 22 so that the grounding pieces are positioned away from the other contacts. The securing portion 31 of the grounding piece 3 is secured in the first tongue portion 12 and the base 13 while the leg 33 of the grounding piece 3 extends out of the rear wall 132 of the base 13. The abutment 312 is exposed out of the protrusion 1211 and in the groove 1212 so that in use a grounding function can be achieved while the protrusion 1211 and the groove 1212 will not be damaged by an inserted mating connector.

The first main parts 43 of the upper and lower inner shells 41 and 42 enclose the rear part 122 of the first tongue portion 12 while the second main parts 44 of the upper and lower inner shells 41 and 42 enclose the base 13.

The insulative housing 10 together with insert molded contacts 21 and 22 and grounding pieces 3 is mounted to the outer shielding shell 5 until the lugs 52 are abutted by the front wall 131 of the base 13. It is noted that a front surface of the lug 52 is located forwardly of the front step 14 of the base 13 so that an over-inserted mating connector will push, if any, the lugs 52 instead of the front step 14 of the base 13, thus preventing any potential damage to the insulative housing 10. Moreover, the second main parts 44 of the upper and lower inner shells 41 and 42 are welded, and therefore grounded, to the interior surface 51 of the outer shielding shell 5. The leg 33 of the grounding piece 3 extends out of the rear wall 132 of the base 13 through the sealing element 6 formed in the groove 151 within the outer shielding shell 5. The outer shielding shell 5 is grounded to a printed circuit board to which the electrical connector is mounted by way of the grounding posts 54.

In a first embodiment of the grounding piece 3, the leg 33 has a contacting portion 34 for contacting directly with the outer shielding shell 5 for grounding purpose. The contacting portion 34 is located behind the sealing element 6.

Figure 11:
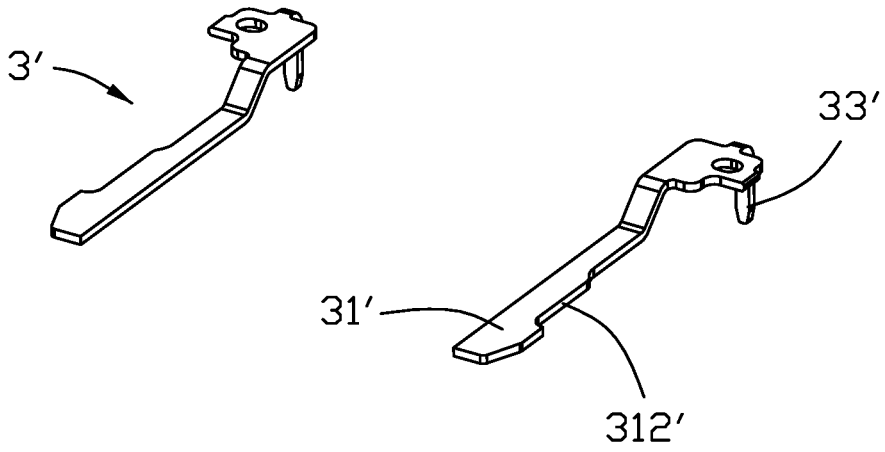
FIG. 11 is a perspective view of a pair of separated grounding pieces according to another embodiment of the present invention.
Figure 12:
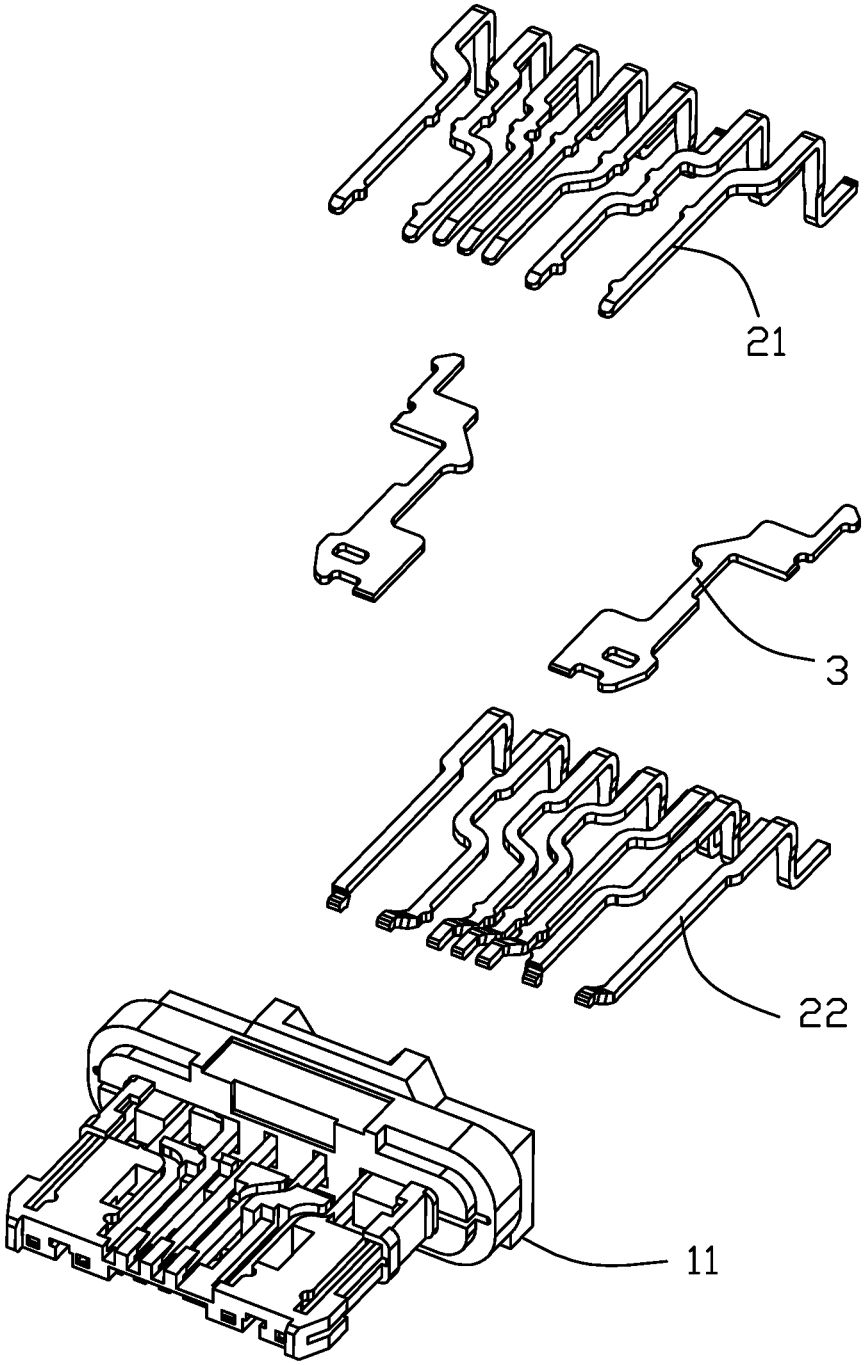
FIG. 12 is an exploded perspective view of the initial terminal module of the electrical connector of the first embodiment of FIG. 1.
Figure 13:
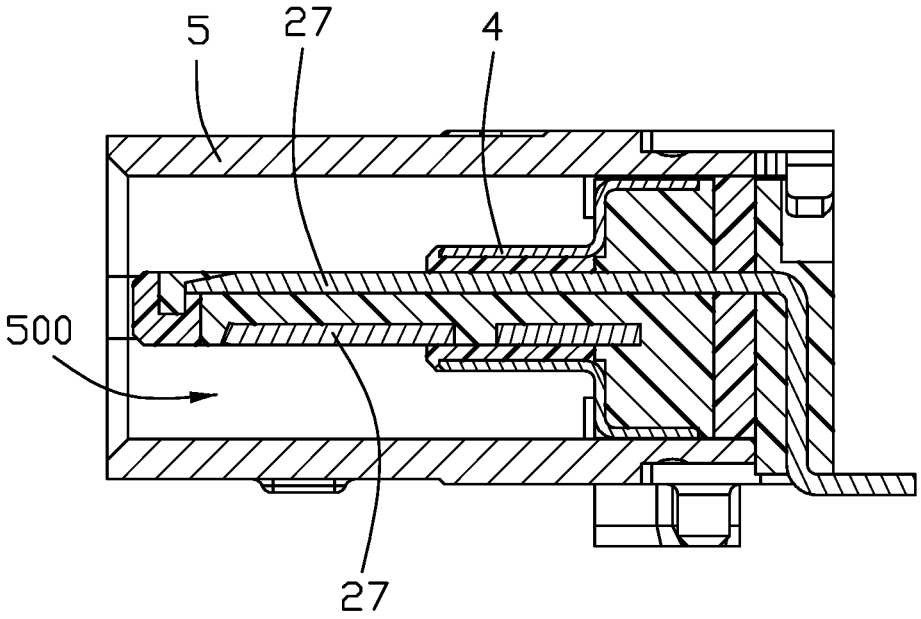
FIG. 13 is a cross-sectional view of the electrical connector of FIG. 1 along line 13-13 to show no traditional shielding plate located between the upper row of contacts and the lower row of contacts wherein the thickness of the contacts is increased compared with that of the traditional contact.

In a second embodiment shown in FIG. 11, the grounding piece 3' has a leg 33' adapted for connecting to the printed circuit board to which the electrical connector is mounted for grounding purpose.

It should be noted that as disclosed in the USB Type C electrical connector specification issued on Mar. 25, 2016 which is being submitted with Information Statement Disclosure of this application, in the traditional connector a thickness of mating tongue is essentially 0.6 mm, the thickness of the upper/lower contact is around 0.15 mm, the thickness of the shielding plate is around 0.10 mm or less, and a distance between the upper/lower contact and the shielding plate is around 0.15~0.175 mm. Understandably, such a relatively tiny distance is not fit for a relatively high current flowing through the contact.

Anyhow, a variation version of the Type C connector is desired by the user to have the less number of the contacts while having capability of quick charging/power effect. In other words, the twenty four contacts of the traditional connector are deemed too many, and only some of them with the specific functions are required for achieving the general signal transmission and the high power transmission. From the technical viewpoint, the corresponding contact should enlarge the cross-sectional for carrying the higher current to implement the quick charging effect. Understandably, the pitch of the remaining contacts is fixed and no space between the adjacent two contacts is available for allowing the contact to enlarge its dimension in the transverse direction. Some connector makers try to use the expensive material for better conductivity thereof for compromising such a high current situation even though it is uneconomic.

The invention uses another approach wherein the contact is intentionally thickened in the vertical direction to enlarge the cross-section of the contact for carrying high current thereof. Understandably, because the mating height in the vertical direction should remain same as the typical/traditional connector, the increased thickness of the contact should inwardly invade the insulative tongue. Therefore, on one hand, because the traditional connector is equipped with the metallic shielding plate between two (upper and lower) rows of contacts in the vertical direction for shielding and grounding, the thickened contact may inevitably shorten the distance between the contact and the shielding plate in the vertical direction, i.e., less than the aforementioned 0.15~0.175 mm, thus significantly increasing the shorting risk, and it is especially true under the high current delivery. On the other hand, in the variation design for the low level use, because the high speed transmission differential pair contacts are not required and can be removed from the traditional full-pin arrangement, the shielding effect provided by the shielding plate is no longer needed.

Therefore, in the invention, the traditional shielding plate is intentionally removed, and only a pair of grounding pieces 3 remain on two opposite lateral side regions and between the (upper and lower) corresponding grounding contact 23 in the vertical direction for latching with the corresponding plug connector and grounding consideration. Therefore, without the shielding plate, the distance between the respective upper and lower power contacts 24 aligned in the vertical direction, each of which has a larger thickness and carries the higher current, is relatively large without possibility of shorting therebetween. In fact, a distance in the vertical direction between the thickened upper power contact 24 and the corresponding thickened lower power contact 24 aligned in the same vertical plane, is not less than 0.3 mm which is clearly larger than 0.15~0.175 mm defined between the upper/lower contact and the shielding plate along the vertical direction in the traditional connector. Therefore, the structure of the invention is fit to carry the high current for quick charging compared with the traditional connector.

In the embodiment, the contact 21 or 22 having a preferable thickness of about 0.2 mm may implement quick changing of a 10 ampere current. Anyhow, a thickness of 0.16 mm may be also another approach. Therefore, a range between 0.16 mm and 0.22 mm may be acceptable. In this embodiment, a thickness of the first contact 21 or the second contact 22 is larger than that of the grounding piece 3. The thickness of the grounding piece 3 is larger than that of the inner shell 41, 42. Anyhow, the thickness of the outer shielding shell 5 around the insertion space 500, is two time of that of the first contact 21 or the second contact 22. Under this arrangement, the whole connector is not only structurally strong enough but also can be easily and economically made. It should be understood that in FIG. 8(B) even if the grounding piece 3 is very closer to the upper/lower grounding contact 23 in the vertical direction, there is no shorting risk because both of them are grounded without power delivery.

What is claimed is:

1. An electrical connector comprising:

an insulative housing including a base, and a tongue extending form the base in a front-to-back direction and forming opposite first and second surfaces on the tongue in a vertical direction perpendicular to said front-to-back direction;

a plurality of first contacts disposed in the housing and arranged in a first row along a transverse direction perpendicular to both said vertical direction and said front-to-back direction with first contacting portions exposed upon the first surface, said first contacts including a pair of first grounding contacts respectively located on two opposite lateral sides of the housing, a pair of first power contacts and a pair of first signal contacts between said pair of first grounding contacts in said transverse direction;

a plurality of second contacts disposed in the housing and arranged in a second row along the transverse direction with second contacting portions exposed upon the second surface, said second contacts including a pair of second grounding contacts respectively located on said two opposite lateral sides of the housing, a pair of second power contacts and a pair of second signal contacts between said pair of second grounding contacts in said transverse direction; and a pair of grounding pieces embedded within a middle level and located on two opposite lateral sides of the tongue, and respectively aligned with the corresponding first grounding contacts and second grounding contacts in the vertical direction; wherein in the tongue, no metallic means is located between the first contacts and the second contacts in the vertical direction except the said pair of grounding pieces are located essentially respectively between the pair of first grounding contacts and the pair of second grounding contacts in the vertical direction;

a thickness of each of the first power contacts and the second power contacts is not less than 0.16 mm; and for each pair of the first power contact and the second power contact having the corresponding first contacting portion and second contacting portion aligned with each other in the vertical direction, a distance between the first contacting portion and the corresponding second contacting portion in the vertical direction is around 0.3 mm.

2. The electrical connector as claimed in claim 1, wherein for each pair of the first power contact and the second power contact having the corresponding first contacting portion and second contacting portion aligned with each other in the vertical direction, a distance between the first contacting portion and the corresponding second contacting portion in the vertical direction is not less than 0.3 mm.

3. The electrical connector as claimed in claim 1, further including a metallic shield enclosing the housing, wherein each of said pair of grounding pieces includes a leg mechanically and electrically contacting said shield.

4. The electrical connector as claimed in claim 1, wherein each of said pair of grounding pieces includes a leg extending downwardly for mounting to a printed circuit board.

5. The electrical connector as claimed in claim 1, wherein each of said grounding pieces includes an abutment sidewardly and outwardly extending slightly beyond a side edge of the tongue.

6. The electrical connector as claimed in claim 1, further including a metallic shield enclosing the housing, wherein a thickness of the first power contact or the second power contact is greater than that of the grounding piece while being less than that of the metallic shield around an insertion space which is formed between the tongue and the metallic shield.

7. The electrical connector as claimed in claim 6, further including an inner shell surrounding a root of the tongue, wherein a thickness of said inner shell is smaller than that of the grounding piece.

8. The electrical connector as claimed in claim 1, wherein four of the first contacts including one first power contact, are densely arranged with one another along the transverse direction while remainders of said first contacts are not.

9. The electrical connector as claimed in claim 1, wherein four of the second contacts including one second power contact, are densely arranged with one another along the transverse direction while remainders of said second contacts are not.

10. The electrical connector as claimed in claim 1, wherein the housing includes a first insert-molding and a second insert-molding, said first insert-molding being unitarily formed with all the first contacts, the second contacts and the pair of grounding pieces via an insert-molding process to commonly form an initial terminal module thereof.

11. An electrical connector comprising:

an insulative housing including a base, and a tongue extending form the base in a front-to-back direction and forming opposite first and second surfaces on the tongue in a vertical direction perpendicular to said front-to-back direction;

a plurality of first contacts disposed in the housing and arranged in a first row along a transverse direction perpendicular to both said vertical direction and said front-to-back direction with first contacting portions exposed upon the first surface, said first contacts including a pair of first grounding contacts respectively located on two opposite lateral sides of the housing, a pair of first power contacts and a pair of first signal contacts between said pair of first grounding contacts in said transverse direction;

a plurality of second contacts disposed in the housing and arranged in a second row along the transverse direction with second contacting portions exposed upon the second surface, said second contacts including a pair of second grounding contacts respectively located on said two opposite lateral sides of the housing, a pair of second power contacts and a pair of second signal contacts between said pair of second grounding contacts in said transverse direction;

a pair of grounding pieces embedded within a middle level and located on two opposite lateral sides of the tongue, and respectively aligned with the corresponding first grounding contacts and second grounding contacts in the vertical direction; and a metallic shield enclosing the housing; wherein in the tongue, no metallic means is located between the first contacts and the second contacts in the vertical direction except the said pair of grounding pieces are located essentially respectively between the pair of first grounding contacts and the pair of second grounding contacts in the vertical direction; and a thickness of the first power contact or the second power contact is greater than that of the grounding piece while being less than that of the metallic shield around an insertion space which is formed between the tongue and the metallic shield.

12. The electrical connector as claimed in claim 11, wherein a thickness of each of the first power contacts and the second power contacts is not less than 0.16 mm.

13. The electrical connector as claimed in claim 11, wherein for each pair of the first power contact and the second power contact having the corresponding first contacting portion and second contacting portion aligned with each other in the vertical direction, a distance between the first contacting portion and the corresponding second contacting portion in the vertical direction is around 0.3 mm.

14. The electrical connector as claimed in claim 11, wherein each of said pair of grounding pieces includes a leg mechanically and electrically contacting said shield.

15. The electrical connector as claimed in claim 11, wherein four of the first contacts including one of the pair of first power contacts are densely arranged with one another along the transverse direction while remainders of the first contacts are not.

16. An electrical connector comprising:

an insulative housing including a base, and a tongue extending form the base in a front-to-back direction and forming opposite first and second surfaces on the tongue in a vertical direction perpendicular to said front-to-back direction;

a plurality of first contacts disposed in the housing and arranged in a first row along a transverse direction perpendicular to both said vertical direction and said front-to-back direction with first contacting portions exposed upon the first surface, said first contacts including a pair of first grounding contacts respectively located on two opposite lateral sides of the housing, a pair of first power contacts and a pair of first signal contacts between said pair of first grounding contacts in said transverse direction;

a plurality of second contacts disposed in the housing and arranged in a second row along the transverse direction with second contacting portions exposed upon the second surface, said second contacts including a pair of second grounding contacts respectively located on said two opposite lateral sides of the housing, a pair of second power contacts and a pair of second signal contacts between said pair of second grounding contacts in said transverse direction; and a pair of grounding pieces embedded within a middle level and located on two opposite lateral sides of the tongue, and respectively aligned with the corresponding first grounding contacts and second grounding contacts in the vertical direction; wherein in the tongue, no metallic means is located between the first contacts and the second contacts in the vertical direction except the said pair of grounding pieces are located essentially respectively between the pair of first grounding contacts and the pair of second grounding contacts in the vertical direction; and four of the first contacts including one of the pair of first power contacts are densely arranged with one another along the transverse direction while remainders of the first contacts are not.

17. The electrical connector as claimed in claim 16, wherein a thickness of each of the first power contacts and the second power contacts is not less than 0.16 mm.

18. The electrical connector as claimed in claim 16, wherein for each pair of the first power contact and the second power contact having the corresponding first contacting portion and second contacting portion aligned with each other in the vertical direction, a distance between the first contacting portion and the corresponding second contacting portion in the vertical direction is around 0.3 mm.

19. The electrical connector as claimed in claim 16, further including a metallic shield enclosing the housing, and wherein each of said pair of grounding pieces includes a leg mechanically and electrically contacting said shield.

20. The electrical connector as claimed in claim 16, further including a metallic shield enclosing the housing, and wherein a thickness of the first power contact or the second power contact is greater than that of the grounding piece while being less than that of the metallic shield around an insertion space which is formed between the tongue and the metallic shield.

* * * * *